United States Patent [19]

Myers

[11] 4,170,459

[45] Oct. 9, 1979

[54] METHOD FOR COLLECTING GLASS FIBERS

[75] Inventor: John E. Myers, Anderson, S.C.

[73] Assignee: Owens-Corning Fiberglas Corporation, Toledo, Ohio

[21] Appl. No.: 913,768

[22] Filed: Jun. 8, 1978

Related U.S. Application Data

[63] Continuation of Ser. No. 761,097, Jan. 21, 1977, abandoned.

[51] Int. Cl.[2] ..... C03B 37/02

[52] U.S. Cl. ..... 65/3 R; 65/2; 65/11 W

[58] Field of Search ..... 65/2, 11 W, 3 R; 28/194; 242/75, 18 G, 45; 156/175

[56] References Cited

U.S. PATENT DOCUMENTS

| | | | |
|---|---|---|---|
| 3,334,980 | 8/1967 | Smith | 65/11 W |
| 3,414,956 | 12/1968 | Genson | 65/11 W X |
| 3,622,290 | 11/1971 | Klink et al. | 65/11 W X |
| 3,771,324 | 11/1973 | Klink et al. | 65/11 W |
| 3,817,728 | 6/1974 | Petersen | 65/11 W X |
| 3,847,579 | 11/1974 | Fulk et al. | 65/2 X |
| 4,071,339 | 1/1978 | Griffiths | 65/3 R X |
| 4,071,340 | 1/1978 | Melle | 65/3 R X |
| 4,071,341 | 1/1978 | Bohy et al. | 65/11 W |
| 4,071,342 | 1/1978 | Schaefer et al. | 65/3 R |

*Primary Examiner*—Robert L. Lindsay, Jr.

*Attorney, Agent, or Firm*—Ronald C. Hudgens; Philip R. Cloutier; Ted C. Gillespie

[57] ABSTRACT

An array of fibers is passed in contact with a contact surface, creating a frictional drag force on the fibers. The drag force is modified to bring the fibers in the array to a uniform alignment in order to more easily divide the array into bundles of fibers.

5 Claims, 3 Drawing Figures

METHOD FOR COLLECTING GLASS FIBERS

This application is a continuation of co-pending application Ser. No. 761,097, filed Jan. 21, 1977 now abandoned.

This invention relates to handling arrays of fibers. More particularly, this invention relates to splitting arrays of fibers into bundles, and collecting the bundles.

In a present fiber collecting operation the fibers in an array are passed into contact with a surface, which can be an applicator surface, and then collected, usually by being wound into a package on a winder. A comb-like splitter is often inserted into the array of fibers just below the applicator surface to divide the fibers into bundles and to produce a split-strand package. The splitter physically separates the array of fibers into bundles of fibers.

Heretofore the insertion of the splitter into the array has been a time-comsuming task, requiring a manual separation of the array into bundles. In the array handling apparatus of the prior art, the fibers of the array generally do not assume a uniform alignment and are continually "dancing", or moving laterally relative to each other. This lack of uniformity of alignment of the fibers makes separation of the array into bundles even more difficult and it is especially difficult to obtain bundles with approximately equal numbers of fibers.

It has now been discovered that increasing the tension of the fibers in the array reduces the "dancing" effect, makes insertion of the splitter easier, and allows the array to be divided into bundles of nearly equal size. The increase in tension can be effected by increasing the frictional drag force applied to the fibers as they contact the applicator surface. The fibers, under the influence of the increased drag force have a tendency to assume the alignment of the source of the array of fibers. For example, fibers pulled from a fiber-forming bushing will, under increased drag force, be more disposed to assume an alignment at the contact surface which corresponds to the alignment of fibers at the bushing.

According to this invention an array of fibers is passed in contact with a surface to produce a first frictional drag force on the array, the array is divided into a plurality of bundles of fibers, the drag force of the surface on the bundles of fibers is modified to produce a second frictional drag force, and the bundles of fibers are collected.

In its preferred embodiment, the first frictional drag force is greater than the second. In its most preferred embodiment the surface is a rotating surface and the frictional drag force is modified from a first frictional drag force to a second frictional drag force by changing the speed of rotation of the surface.

In another embodiment of this invention the frictional drag force is modified by changing the amount of lubrication applied to the surface.

In yet another embodiment of this invention the frictional drag force is modified by changing the area of contact between the fibers and the surface.

There is also provided apparatus for collecting an array of fibers including a surface which is contacted by the array of fibers to produce a first frictional drag force on the fibers, a splitter means for dividing the array into bundles, means for modifying the frictional drag force to a second frictional drag force, and means for receiving the bundles of fibers. The surface can be an applicator surface for a sizing material. In the most preferred embodiment of this invention the surface is rotatable, and the means for modifying the frictional drag force comprises means for rotating the surface at at least two speeds.

In another embodiment of this invention the means for modifying the frictional drag force comprises means for changing the amount of a lubricant applied to the surface.

In yet another embodiment of this invention the means for modifying the frictional drag force comprises means for modifying the amount of contact between the fibers and the surface.

The method and apparatus of this invention are particularly suitable for the handling of an array of glass fibers, especially glass fibers drawn from a fiber-forming bushing, a typical bushing being illustrated in FIGS. 1 and 2.

Figure 1:
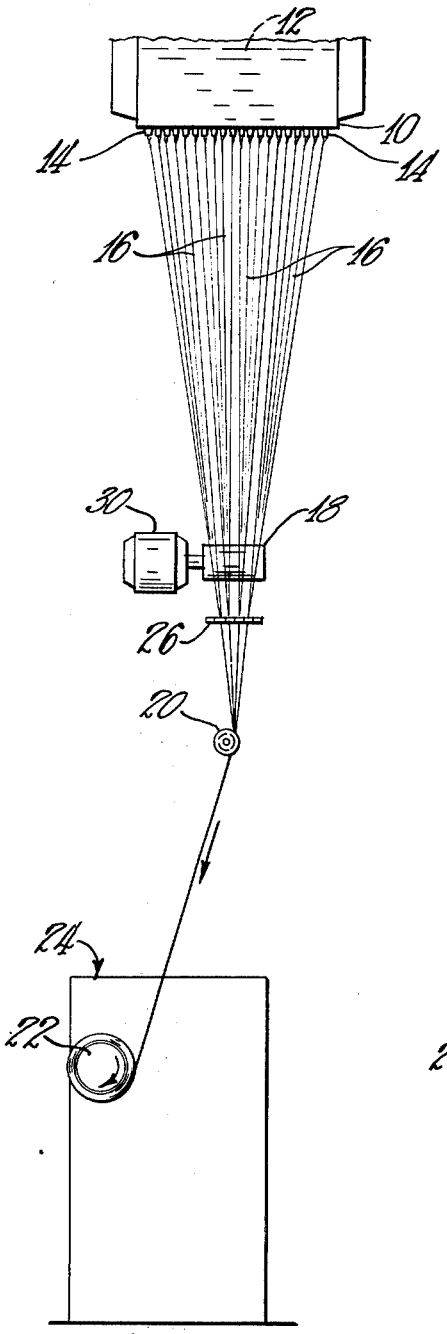
FIG. 1 is a front elevation view of a fiber-forming bushing and fiber array handling apparatus according to the principles of this invention.

Referring now to the figures, there is shown bushing 10 comprising a chamber for holding glass mass 12. The chamber is adapted with orifices 14 through which glass is emitted and attenuated into fibers 16 in the form of an array.

The fan of fibers is passed in contact with contact surface 18, thereby creating a frictional drag force on the fibers. Below the contact surface the fibers are contacted by gathering member 20 which is suitable for gathering the fibers into a strand. The strand can then be collected on rotating collet 22 of winder 24, which can be a conventional winder.

Figure 2:
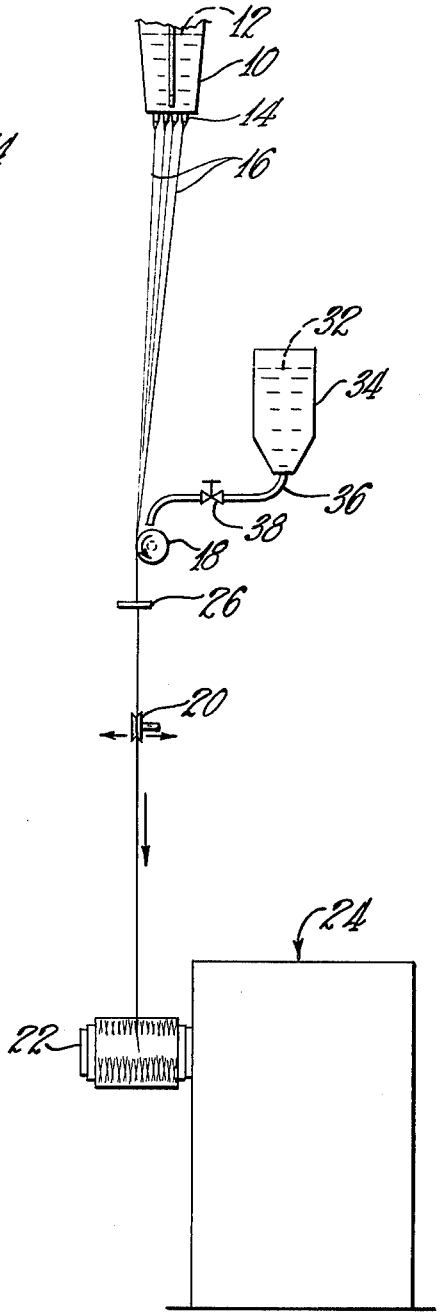
FIG. 2 is a side elevation view of apparatus according to the principles of this invention.
Figure 3:
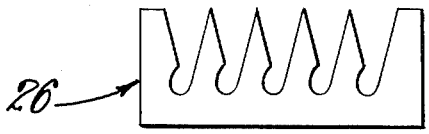
FIG. 3 is a plan view of the splitter shown in FIGS. 1 and 2.

In order to divide the array of fibers into bundles of fibers, splitter 26 is inserted into the array. The splitter can be inserted manually. The comb-like splitter has projections to maintain separation between fiber bundles. It is usually desirable to divide the array evenly to obtain bundles containing substantially equal number of fibers. Subsequent to this splitting process, the bundles of fibers can be combined to form a single strand, as shown in FIGS. 1 and 2. The bundles can also be collected while the separation between bundles is maintained.

One method which can be used to modify the drag force exerted by the contact surface from a first drag force to a second drag force is to make the contact surface rotatable and to rotate the contact surface at different speeds. For example, in a typical fiber forming and collecting operation, a rotating size applicator surface is utilized to contact the fibers and apply a size. By changing the speed of rotation of the applicator surface, the drag force on the fibers is modified. The rotation of the applicator surface can be accomplished by means of variable speed motor 30 shown in FIG. 1.

In another embodiment of this invention the frictional drag force applied to the fibers by the contact surface is modified by changing the amount of lubrication applied to the contact surface. An increase in the amount of lubrication decreases the drag force on the fibers. For example, as shown in FIG. 2, lubricant 32 flows from reservoir 34 through conduit 36 and onto the contact surface. Valve 38 controls the amount of lubricant deposited. In a typical fiber forming and collecting operation, a size is applied to the fibers at the contact surface, and the size acts as a lubricant.

It is to be understood that the contact surface of this invention can be a rotatable size applicator of the type in which the rotating surface contacts a size reservoir to become coated with a size and in which increasing the speed of rotation results in an increase in the amount of size coating the applicator surface. Thus, the drag force from such an applicator can be reduced by increasing the rotational speed of the applicator; this results in an increase in the amount of size coating the applicator surface.

In another embodiment of this invention, the frictional force applied to the fibers by the contact surface is modified by changing the amount of contact between the fibers and the contact surface. If the contact surface is curved, as shown in FIG. 2, this can be accomplished by increasing the angle of wrap of the fibers around the curved surface. For example, movement of the gathering member along the path indicated by the arrows in FIG. 2 has the effect modifying the wrap angle at the contact surface. As the gathering member in FIG. 2 is moved to the right, the wrap angle increases, thereby increasing the drag force and producing a more uniform alignment of fibers in the array. It is also possible for the contact surface to be moved to change the amount of contact between the fibers and the contact surface.

It will be evident that various modifications can be made to this invention. Such, however, are considered as being within the scope of the invention.

I claim:

1. In a process for collecting an array of split strand fibers in which fibers are attenuated from a bushing containing molten material, a strand of the fibers is passed into contact with a size applicator surface, thereby producing a frictional drag force, a strand splitter is inserted into said strand to produce an array of split strand fibers, and said array of split strand fibers is collected as a package, the improvement comprising increasing the frictional drag force produced by contact with said size applicator surface prior to the insertion of said strand splitter said frictional drag force being sufficient to reduce the dancing effect made by the fibers and to allign the fibers, and re-establishing the frictional drag force subsequent to the insertion of said strand splitter.

2. The method of claim 1 in which said size applicator surface is a rotating surface, and the frictional drag force is increased by changing the speed of rotation of said size applicator surface.

3. The method of claim 2 in which changing the speed of rotation of said size applicator surface comprises slowing the speed of rotation.

4. The method of claim 1 in which the frictional drag force is increased by changing the amount of lubricant applied to said size applicator surface.

5. The method of claim 1 in which the frictional drag force is increased by changing the area of contact between said strand of fibers and said size applicator surface.

* * * * *